US005903216A

United States Patent [19]

Sutsos et al.

[11] Patent Number: 5,903,216

[45] **Date of Patent: *May 11, 1999**

[54] SECURITY STRUCTURE UNLOCKING SYSTEM FOR USE BY EMERGENCY RESPONSE AND AUTHORIZED PERSONNEL

[76] Inventors: Pete Sutsos, P.O. Box 140, Sonoma, Calif. 95476; Robert Triebel, 5523 Mulberry Dr., Santa Rosa, Calif. 95409; David Nisenson; Robert Baeyen, both of 850 West Napa St., Sonoma, Calif. 95476

[ * ] Notice: This patent is subject to a terminal disclaimer.

[21] Appl. No.: 08/852,516

[22] Filed: May 7, 1997

Related U.S. Application Data

[63] Continuation-in-part of application No. 08/764,502, Dec. 12, 1996.

[51] Int. Cl.[6] ..... E05B 45/06

[52] U.S. Cl. ..... 340/542; 340/904; 340/539; 340/825.31; 340/825.32; 379/39; 70/257

[58] Field of Search ..... 340/542, 902, 340/904, 539, 825.31, 825.72, 825.73, 331, 332, 504, 506, 531, 825.69; 379/37, 39, 40; 70/257, 278

[56] References Cited

U.S. PATENT DOCUMENTS

| | | | |
|---|---|---|---|
| 4,616,444 | 10/1986 | Taylor | 49/347 |
| 4,667,440 | 5/1987 | Grace | 49/237 |
| 5,325,084 | 6/1994 | Timm et al. | 340/541 |
| 5,541,585 | 7/1996 | Duhame et al. | 340/825.69 |
| 5,680,119 | 10/1997 | Magliari et al. | 340/904 |

OTHER PUBLICATIONS

B.F. Goodrich Aerospace, "Radio Control", Lighting Systems Division, Oldsmar, Florida.

*Primary Examiner*—Jeffery A. Hofsass
*Assistant Examiner*—Daryl C. Pope
*Attorney, Agent, or Firm*—Flehr Hohbach Test Albrittton & Herbert LLP

[57] ABSTRACT

A security structure-opening assembly (12) for use in unlocking a locked structure (24) comprising: a radio frequency receiver (16) formed to detect radio frequency signals on a radio frequency; an actuator (20) coupled to the receiver (16) and formed for coupling to one of a security structure lock assembly (25) and an unlocking mechanism (22A) for a security structure lock assembly (25) at a position by-passing any authorized user input device (23); the receiver (16) being responsive to detected signals to actuate the actuator (20) and produce unlocking of the lock assembly (25). At progressively higher levels of security, the radio signal is analyzed by a private line detector circuit (30), a digital burst detector circuit (31) and a decoder circuit (32).

A method for providing a security structure-opening system (12) for a locked structure (24) having an authorized user input device (23) comprising the steps of: coupling a radio frequency receiver assembly (16) to a lock assembly (25) for the locked structure at a position by-passing the authorized user input device (23), the receiver assembly (16) being formed to detect the presence of signals on a radio frequency and formed to be responsive to a detected signal to unlock the lock assembly (25); and unlocking the lock assembly (25) by transmitting a signal on a radio frequency to the receiver (16). At progressively higher levels of security, the process includes the steps of analyzing the radio signal by a private line detector circuit (30), by a digital burst detector circuit (31) and by a decoder circuit (32).

14 Claims, 1 Drawing Sheet

SECURITY STRUCTURE UNLOCKING SYSTEM FOR USE BY EMERGENCY RESPONSE AND AUTHORIZED PERSONNEL

RELATED APPLICATION

The present application is a continuation-in-part of U.S. patent application Ser. No. 08/764,502, filed Dec. 12, 1996.

TECHNICAL FIELD

The present invention relates to systems for unlocking gated areas and more particularly to systems for unlocking gated areas and secure controlled doorways using remote radio controlled devices.

BACKGROUND AND OBJECTS OF THE INVENTION

Privately-gated communities, privately-gated residences, secure controlled doorways, restricted government access areas, garage-doors and lock boxes, and other restricted access or gated areas provide security against potential intruders but have the disadvantage of hindering emergency response personnel, such as police, fire and ambulance services, from quickly entering the gated area as required in emergency situations. This is due to the fact that security gates or other structures are designed to require an operator to carry keys or to know access entry codes, or to carry a transmitter which generates a personalized entry code, in order to open such secure structures. Consequently, the entering of such a gated or access-restricted area presents considerable problems for emergency personnel trying to move swiftly through, or respond to calls in, such a gated area, or when trying to open a restricted-access area. What is instead desired is a system in which the security structures are effective barriers to unauthorized personnel and yet emergency personnel are able to quickly and easily enter these areas. It is, accordingly, an object of the present invention to provide a remote controlled system enabling emergency response personnel, or certain auxiliary authorized personnel, to quickly and easily enter restricted-access areas such as privately-gated residences and communities and secure controlled doorways without having to carry keys, know access codes, or carry the owner's encoded transmitter for each locked gate or other security structure.

Another important design consideration is that the desired gate-opening system must be designed such that only licensed emergency personnel or auxiliary authorized personnel are able to operate the system. If this were not the case, and if other individuals were able to operate, tamper or break into this system, the very security purpose of the security structure itself would be compromised as this structure would be easily openable by unauthorized personnel. Accordingly, it is an object of the present system that it cannot be operated by anyone other than licensed emergency response and auxiliary authorized personnel.

At greater levels of security, it may also be desirable to restrict access to a particular locked structure to only certain pre-authorized auxiliary personnel within or even outside a particular emergency response agency. Stated differently, it may be desirable that all of the persons within a particular emergency response agency may not have the same authority to access a particular locked structure. It is, therefore, a further object that the present system be able to identify the particular individual who is attempting to activate the present unlocking system, and determine whether this individual is pre-authorized to activate the unlocking system, as a pre-condition to activating the unlocking system.

Although the present invention is primarily directed towards emergency response personnel agencies for security reasons which will be set forth herein, it is a further object that the present system be also be adaptable such that it can be activated by auxiliary personnel in agencies other than those which are considered to be strictly "emergency response". For example, public utilities including gas companies, telephone companies and even cleaning services may be selectively afforded authorization to operate the present system. As will be explained, however, the ability of the present system to selectively provide access to locked security structures or secure controlled doorways to such non-emergency response auxiliary personnel will be under the control of the system owner, such that high levels of security can be maintained at all times.

As a security back-up, it is a further object that the identity of the individual persons activating the unlocking system be recorded for future reference by the unlocking system itself. Preferably, a form of recorded "activity log" would be generated to provide a record of those individuals who activated the unlocking system, the emergency response agency to which they are affiliated, and the date and time at which the security structure was unlocked.

Having security structures including the gates of privately-gated communities, residences, secure controlled doorways or lock boxes for residences, industrial buildings or other security structures openable by some form of remote control device located in the emergency response or other vehicles itself would enable such structures to be opened easily and in a timely fashion without emergency response personnel even having to get out of their vehicles. It is accordingly an object of the present invention that an emergency response person or authorized auxiliary person be able to open security gates, doors and other locked enclosures without even having to leave their vehicle.

Existing remote control door opening devices, (such as garage door openers), are typically designed to be operated at a selected control frequency such that a door or gate is opened in response to the transmission of a coded signal over the particular frequency from a limited range, remote control transmitter. With such devices, different coded signals are used to open different doors or gates. By having the range of transmitters limited simply by their relatively low power and by having various garage door openers each set to different codes for their activation, the chance of any garage door opener inadvertently opening a neighbor's garage-door is remote. Fundamental problems exist with attempting to adapt this form of door opening system to solve the present problem, as set out below.

Being set at a specific pre-set coded signals, a separate garage door opener is required to open virtually every garage door. It is, accordingly, another object of the present invention that this problem be overcome by providing a universal emergency response gate-opening system designed to allow an emergency response person or authorized auxiliary person to open many different private gates without being required to have and operate a plurality of different coded gate-opening devices corresponding to each of the various locked gates.

It is a further object of the present invention to provide a system which would not be easily openable by various public-access radio frequency transmissions. It is still another object that the use of the universal emergency response gate opening system of the present invention will not inadvertently unlock other neighboring locked gates in the vicinity of the particular locked gate which is desired to be opened.

Moreover, it is another object of the present invention that emergency personnel should not be required to carry an additional or "extra" security-structure opening device in addition to all the other emergency equipment which they must now carry. Such an "extra" device would need to be issued to all emergency personnel, including police, fire, ambulance, etc. This raises the problem of certain emergency personnel inadvertently not being issued with such equipment. This "extra" device could inadvertently be lost and thus fall into the hands of an unauthorized person. In addition, it is an object of the present invention that the system not be limited to operate only in a particular geographic area or only with a few pre-selected locked structures. Moreover, the universal security-structure unlocking system should not be difficult or time consuming to operate or to learn to operate.

Furthermore, it is an object that the present security-structure opening system not require excessive retrofitting to be installed nor require technical equipment modification or standardization to be operable by a variety of existing emergency response agencies. Thus, this system should be easily adapted for use by police, ambulance and fire department personnel without the need for any inter-agency co-ordination. As such, it is yet another object that this system be adapted to augment the usefulness of existing devices already used and carried by emergency response personnel as this would eliminate the need for extensive equipment modification or retrofitting.

Various systems already exist for remotely opening gates through the use of various radio controlled devices. Examples may be found in U.S. Pat. No. 4,616,444 to Taylor and U.S. Pat. No. 4,667,440 to Grace, Sr. Unfortunately, these systems are very limited in addressing all the security concerns of the present invention as these patented devices do not disclose any security features in regard to the actual radio controlled operation of their gate opening systems. Rather, the systems of the Taylor and Grace patents simply disclose that some existing form of radio transmitters, presumably coded signals, can be used to activate the gate opening system. These systems, therefore, are not adaptable to solve the present problems of emergency response personnel desiring to quickly open privately-gated residences and communities.

DISCLOSURE OF THE INVENTION

The present system provides a locked structural assembly comprising: a structure having a movable security structure and a lock assembly formed to lock the security structure in a closed position; an unlocking mechanism coupled to and formed for unlocking of the lock assembly; and an emergency response security structure-opening assembly coupled to the unlocking mechanism at a position by-passing an authorized user input device and including a radio frequency receiver formed to detect the presence of a radio frequency signal on at least one radio frequency, and the security structure-opening assembly further being responsive only to detection of the signal in the radio frequency to actuate the unlocking mechanism.

The present locked structural assembly provides a hierarchy of security levels which preferably include a private line detector circuit formed to detect the presence of a private line signal, a digital burst detector circuit formed to detect the presence of a encoded digital burst signal, and a decoder circuit formed to decode the encoded digital signal.

The present invention provides a method for opening a locked structure using a remote radio transmitter, the locked structure being equipped with a radio frequency scanner/receiver coupled to control an unlocking mechanism connected to a lock assembly for the structure, comprising the steps of: coupling a radio frequency receiver assembly to a lock assembly for the locked structure at a position by-passing the authorized user input device, the receiver assembly being formed to detect the presence of signals on a radio frequency and formed to be responsive to a detected signal to unlock the lock assembly; and unlocking the lock assembly by transmitting a signal on the radio frequency to receiver.

The preferred method further comprises the sequential steps of passing a signal from the receiver to an authorized carrier detector circuit formed to detect whether a radio transmission received by the receiver is pulsed, passing a second signal from the authorized carrier detector circuit to a private line detector circuit formed to detect whether the radio transmission received by the receiver has a private line component, and passing a third signal from the private line detector circuit to a digital burst detector circuit formed to detect whether the radio transmission received by the receiver has a digital burst component. Lastly, the preferred method further comprises the step of passing a fourth signal from the digital burst detector circuit to a decoder circuit formed to decode the digital burst.

BRIEF DESCRIPTION OF THE DRAWING

The FIGURE is a schematic block diagram of the present invention.

BEST MODE OF CARRYING OUT THE PRESENT INVENTION

Figure 1:
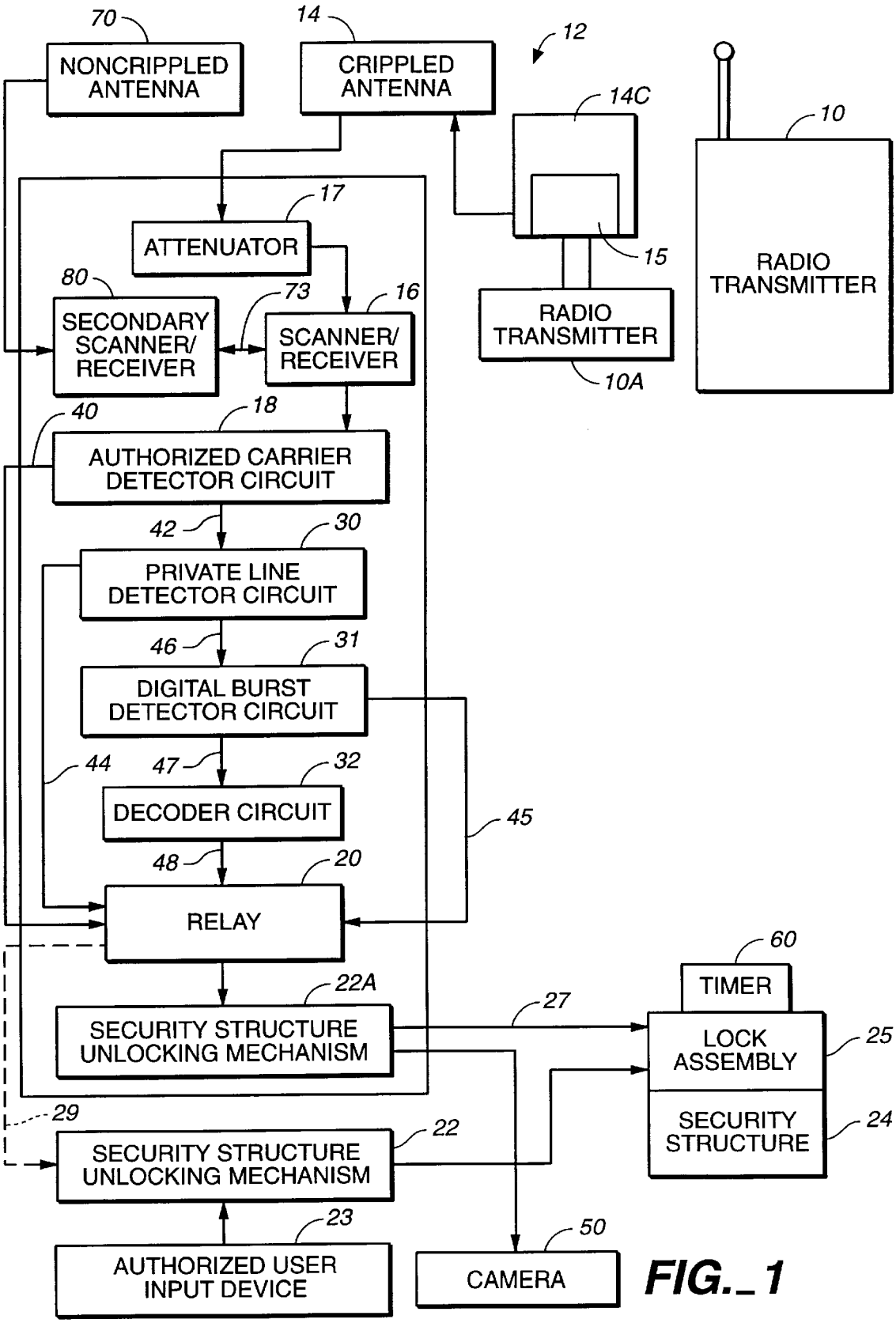

Privately-gated homes, secure controlled doorways, locked government and industrial complexes and schools, gated communities and multiple user lock boxes all pose problems for emergency response personnel attempting to quickly and easily enter or pass through these gates or locked entrances in times of emergency. The present invention provides an apparatus and method for emergency response personnel to quickly and easily open private locked security structures without having to carry keys or a plurality of encoded transmitters and without knowing access codes, and most preferably, without even having to exit from their vehicles. This emergency response security structure opening system is not operable by persons other than pre-authorized or licensed emergency response personnel and has the further advantage that personnel from different emergency response agencies can use the same system to open different locked security structures in different geographic areas, without the risk of inadvertently opening other security structures in the vicinity.

Another important feature of the present invention is that it can be adapted to identify and distinguish between particular emergency response individuals, (even if they are members of the same emergency response agency), such that access to the unlocking system of the present invention can be pre-authorized or denied to particular individuals, as desired. This feature provides an added layer of security which will be expanded upon hereunder.

Referring now to the FIGURE, a block diagram of a universal, emergency-response security structure opening system constructed in accordance with the present invention is shown. A security structure such as a gate, door or lock box 24 provided with a lock assembly 25 which is connected to a security structure unlocking mechanism 22. As used herein, "security structure" shall include any structural closure member. Unlocking mechanism 22 can be a solenoid or other actuator which usually will be electrically powered and is connected to an authorized user input device 23. In addition, unlocking mechanism 22A can also be adapted to be connected to a camera 50 which photographs the individual accessing security structure 24 at the moment the security structure is unlocked. Input device 23 can be a key pad for manual input of an authorized user opening code, or it could be a radio frequency receiver, an optical receiver or any other form of input device to unlocking mechanism 22, including a key-receiving tumbler lock.

Thus, if input device 23 receives radio frequency signals from an authorized user-held radio transmitter (not shown) the system for unlocking security structure 24 would essentially be a garage door opening system. A coded signal would be transmitted to input device 23, which would be responsive only to such a coded signal on a predetermined transmission frequency to open lock assembly 25 for security structure 24.

Such equipment, of course, is generally employed in gated structural applications such as houses, communities, secure controlled doorways, industrial complexes or other security structures such as lock boxes. Since each house/community complex lock box will have its own unique coding system for authorized users, multiple security structures would require multiple coded authorized user devices for emergency agencies.

Accordingly, in the system of the present invention a security structure opening assembly, generally designated 12, is coupled to lock assembly 25 for security structure 24 to enable by-passing of the authorized user input device 23. Security structure opening assembly 12 can have its own security structure unlocking mechanism or actuator 22A so as to be a completely stand-alone assembly which is coupled directly to lock assembly 25, as indicated by arrow 27. Alternatively, auxiliary security structure unlocking mechanism 22A can be eliminated and the output of assembly 12 coupled to the existing security structure unlocking actuator or mechanism 22 for lock 25, as indicated by arrow 29.

The emergency response security structure unlocking system of the present invention includes two main components, namely, a radio frequency transmitter 10 and the security structure opening assembly 12. As is broadly the case for garage door opener systems, the present system transmitter 10, which is operated by emergency response personnel and produces a radio frequency signal that is received by antenna 14 of a receiver 16. In the present system, as will be explained, the receiver 16 is preferably a receiver/scanner.

Emergency response personnel, regardless of whether they are police, fire, ambulance, forestry, customs, etc. are all typically equipped with radio transmitters for communication with a dispatcher or base station and for communication with other emergency response personnel. The particular radio frequencies upon which messages are transmitted are restricted by the Federal Communications Commission (FCC) in the United States, and by similar regulatory agencies in other countries, such that private individuals may not legally broadcast on emergency response restricted frequencies or even possess devices for transmitting signals on such restricted frequencies. Although transmission upon emergency response frequencies is restricted only to licensed emergency response agencies, the reception of these transmissions is not restricted and private individuals may lawfully receive such signals. By contrast, the FCC assigns different frequencies for commercially available remote door opening systems generally available to the public and anyone can possess a transmitter suitable for transmitting signals on such frequencies. Input device 23, for example, would operate on a generally available FCC non-emergency response frequency. In one aspect, the present system applies the principle that emergency response agencies' radio transmissions are broadcast only on restricted access radio frequencies, while other remotely operated systems are broadcast on publicly available frequencies, to provide a system for opening locked security structures.

Scanner 16 of the present invention, therefore, can be constructed to scan only the emergency response frequencies assigned by the FCC to the particular area in which security structure 24 is located. Standard emergency response radio transmitter 10, which is typically mounted in an emergency response vehicle, will be transmitting signals on emergency frequencies while unauthorized user transmitters will not.

Scanner 16 is preferably a slightly modified version of one of the well known existing type of scanners that sequentially scan a number of different frequencies used by the various emergency response personnel in the area. These existing scanners are designed to monitor one pre-set or pre-programmed emergency response frequency for a short period of time, and if no transmissions are detected on this frequency, they then adjust to monitor another pre-set emergency response frequency for a short period of time. The steps of switching between various pre-set frequencies are repeated as each pre-set frequency is monitored in turn. In such systems, if transmissions are detected on any of the pre-set frequencies, the scanner is designed to then remain tuned to this frequency so that a user is able to listen in on the radio conversation through the system's accompanying loudspeaker. The frequencies which such scanners are adapted to monitor are typically either pre-programmed directly into the scanner, in the case of the newer more advanced models, or are pre-set with each frequency to be monitored are fixed on individual computer chips which are received onto a bank of sockets, in the case of older models of scanners.

The present scanner 16 is similarly constructed to these prior art scanners. The difference between the present scanner and prior art scanners is that if the present scanner 16 detects transmission broadcasts on any of the frequencies being monitored, under certain conditions and subject to further progressive levels of security which will be set forth hereunder, it is adapted to signal a relay circuit 20 which in turn activates security structure unlocking mechanism 22 or 22A to unlock security structure lock 25 and security structure 24. Furthermore, for reasons to be explained herein, the present scanner 16 need not be operated such that it remains tuned to a particular frequency for an extended period of time simply because radio transmissions were detected on this monitored frequency. Also important to the present system is the fact that the signal sent from scanner 16 to security structure unlocking mechanism 22, 22A preferably passes through an authorized carrier detection circuit 18, (and optionally through a private line detector circuit 30, a digital burst detector circuit 31 and a decoder circuit 32, as required), before reaching relay circuit 20, the purpose and function of which will be described below.

As frequencies used by emergency response personnel may vary from one geographic area to another, it is important that the programmer or installer of scanner 16 customize the set-up of the scanner such that the particular frequencies which the scanner monitors can be adjusted. Scanner 16 may either be of the type in which the frequencies to be monitored are pre-programmed or of the type in which the frequencies to be monitored are individually fixed on computer chips which are received onto a bank of sockets in the scanner. The security advantage with using the latter type of scanner in the present system is that it can not be broken into such that other, non-restricted radio frequencies could be set to activate the emergency door opening system. As a further security measure, therefore, scanner 16 is preferentially equipped with a unique Personal Identification Number (PIN) such that it can only be pre-programmed or operated only by an authorized user who knows and enters the scanner's PIN number. Although the possibility exists that unauthorized persons could possess illegal equipment allowing them to make radio transmissions on restricted emergency frequencies, thus allowing them to open the locked security structure, the potential for this type of activity is greatly reduced as such transmissions, by definition, have to be made on frequencies monitored by emergency response personnel, thus alerting them to the presence of unauthorized users.

A particular advantage of the present system is that in one aspect scanner 16 can be pre-programmed to respond only to certain emergency response agencies as desired by the security structure owner. Typically, scanner 16 will be pre-programmed such that the radio frequencies used by police, fire and ambulance agencies in the local geographic area will be monitored by the scanner. In addition, however, additional radio frequencies such as those used by other agencies such as the National Forestry Service, Customs officials, etc. may also be selectively added to the present scanner. Moreover, in another aspect of the present invention any pre-programmed radio frequency can be used, although when non-emergency frequencies are used, the scanner/receiver assembly preferably includes a screening circuit which provides additional security. Moreover, when non-emergency frequencies are used, they preferably are a frequency other than the frequency used by the system owner as the authorized input device 23. As the particular radio frequencies which activate the present system are pre-programmed into the scanner 16, the addition or deletion of any particular agency's ability to command the unlocking of the locked security structure by the present system would remain under the control of the security structure owner, requiring the owner's entering the PIN activation number to access the programming functions of scanner 16, thereby allowing selective security structure opening by desired emergency agencies or auxiliary authorized personnel only. It is further within the scope of the present invention that scanner/receiver 16 be only a receiver pre-programmed to receive radio frequency signals at only one emergency response frequency. In the broadest case, therefore, the security structure opening system includes a radio frequency receiver formed to receive signals on at least one frequency and to respond thereto to cause unlocking of security structure or lock box 24.

Should the system owner instead wish to operate the present system such that access is authorized for auxiliary non-emergency response agencies, (ie: those agencies who transmit on non-restricted radio frequencies), the operator instead (or additionally) programs scanner/receiver 16 to scan the particular radio frequencies used by these auxiliary agencies. It is recognized that in so programming scanner/receiver 16 to scan one or more non-restricted frequencies, the risk of an unauthorized person making a radio transmission on these frequencies, (which are not monitored or listed to by police or other emergency response agencies) is increased. Accordingly, although this arrangement of the present invention keeps within the scope of the present invention, it is only recommended for relatively low security applications, unless one or more of the additional levels of security set out below are concurrently used.

To provide a truly secure system, the present invention is also provided with numerous practical safeguards so that it will not allow the unlocking or opening of a secure locked security structure whenever an emergency response team or other authorized agency uses its radio transmitter in the neighborhood of receiver/scanner 16 and locked security structure 24.

First, antenna 14, which is connected to scanner/receiver 16, is preferably "crippled" or has its receiving sensitivity reduced such that it preferably has a very short range. Being "crippled", it is therefore only able to receive transmissions from an emergency response vehicle's transmitter 10 if transmitter 10 is positioned in very close proximity to antenna 14. Ideally, "crippling" of the antenna reduces its ability to receive radio transmissions to such a degree that the radio transmitter used by the authorized personnel is required to actually be within several yards of the antenna 14, typically necessitating the response vehicle itself be driven to a position just in front of the security structure to be opened.

Antenna 14 can be crippled by several means. First, an attenuator 17, (preferably a resistive "T" pad attenuator), can be inserted between antenna 14 and scanner/receiver 16. The use of attenuator 17 "cripples" the reception and thereby limits the sensitivity of antenna 14. The factors upon which the attenuation requirements are to be based can preferably include the decibel attenuation required and the impedance of the transmission line. Antenna 14 may be covered by a clear plastic preventing weather damage, yet allowing access to radio waves. Secondly, the use of metal shielding can be used to prevent unwanted radio transmissions from entering the system. The "crippling" ensures that the locked security structure is only opened by the present security structure opening system when an emergency response transmitter is in its immediate presence.

"Crippling" of the reception sensitivity of antenna 14 thus ensures that the security structure is not inadvertently unlocked or opened simply by any of the normal emergency response radio transmissions which are continuously occurring throughout the neighborhood. Rather, radio transmitter 10 must be positioned quite near antenna 14 before the "crippled" antenna will pass such transmissions through to scanner/receiver 16.

"Crippling" of the receiving sensitivity of antenna 14 has the added advantage that no modification need to be made to the relatively high output wattage of radio transmitters 10 which are carried by the various emergency response personnel on their person or in their vehicles. Rather, high powered transmitters 10 need not have their power reduced or their ability to communicate over large distances compromised as is, of course, necessary for emergency agencies. Antenna 14 of the present invention, therefore, is adapted only to have sufficient sensitivity to pass even high-powered radio transmissions only when they are sent in the very near proximity to antenna 14.

Preferably, scanner 16, authorized carrier detector circuit 18, private line detector circuit 30, digital burst detector circuit 31, decoder circuit 32 and relay 20 all will be mounted together in a secure housing 11. Most preferably, the functions as set forth herein of authorized carrier circuit 18, private line detector circuit 30 and digital burst detector circuit 31 will be designed and programmed directly into the circuitry of scanner/receiver 16.

Alternatively, the functions of authorized carrier circuit 18 and private line detector circuit 30 or private line detector circuit 30 and digital burst detector circuit 31 could be accomplished together in the same circuit assembly. Other combinations are of course possible keeping within the scope of the present invention. Accordingly, the representation shown in the FIGURE where scanner 16, secondary scanner 80, authorized carrier circuit 18, private line detector circuit 30 and digital burst detector circuit 31 are shown as being separate components is meant only to clearly show the separate functions of these components of the present system. This representation is not meant to be limiting as to requiring the circuitry of these components to be separate from one another. The forgoing is also true with respect to decoder circuit 32, however, as a practical matter, this component of the present invention is most likely to be separate from scanner/receiver 16.

The scanner/receiver/security structure opener system 12 is preferably powered by a 12 or 24 Volt D.C. power supply. Housing 11 may preferably be mounted on or next to the locked security structure itself, and coupled to drive existing security structure unlocking actuator 22 or provided with its own unloading actuator 22A.

As the present antenna 14 has a "crippled" or reduced sensitivity, it can only sense radio transmissions made from response vehicle radios within several feet of antenna 14. However, response personnel also often carry hand-held radio transmitters which are typically much weaker in power than the transmitters found in response vehicles. The present invention is also adapted to enable use of these much weaker transmitters to open security structures and lock boxes. In many cases, this can be accomplished simply by positioning the antenna of radio transmitter 10A directly against the side of antenna 14 or in very close proximity with antenna 14. Alternatively, antenna assembly 14 can be provided with a shielded access port 15 into which antenna 31 of a hand-held transmitter 10A can be inserted. Access port 15 is preferably kept shielded from the environment by a spring-activated door. As is seen in the FIGURE, access port 15 can be positioned in a separate antenna 14C which is placed at a location removed from that of antenna 14. Such remote positioning of antenna 14C is particularly useful when positioning antenna 14C at a height within easy reach of a response person holding a radio transmitter 10A, yet still enables antenna 14 to be attached to a pole at greater out-of-reach height above the ground as a precaution against vandalism. Although access port 15 can be positioned in a remote antenna 14C, it is also within the scope of the present invention, however, to locate access port proximal antenna assembly 14. By positioning the antenna of hand-held transmitter 10A directly into access port 15, the same control over opening the locked security structure is achieved as would be achieved by the more powerful transmitter 10 being located in the response vehicle located several yards from antenna 14.

A further security advantage of the present design is that should an unauthorized person attempt to gain entry to the locked structure by illegally transmitting a signal on a radio frequency reserved for authorized emergency response personnel, and should the unauthorized person attempt to use a transmitter having a weak enough signal such that the transmission can not be listened in by authorized emergency response agencies, (thereby being alerted to the transmission), the weakened signal will not be strong enough to activate the present system due to the "crippling" of the antenna receiving the signal. In other words, to activate the present system, the radio signal required would have to be strong enough to be detected by the various emergency response agencies' dispatchers.

Yet another important safeguard may be used to ensure that the radio transmissions made by a response vehicle's transmitter do not inadvertently open a locked security structure when the vehicle is simply driving by the locked security structure. This safeguard is accomplished using an authorized carrier detection circuit 18 to determine whether the radio transmission is intended to open security structure 24 or is merely a spurious transmission. One convenient way of distinguishing between intended and spurious transmissions is to require that the transmission be pulsed on and off a number of times within a pre-programmed fixed time interval. Authorized carrier detector circuit 18 is actuated by the reception of an emergency response radio transmission signal detected by scanner 16. The authorized carrier detector circuit then waits a specific pre-programmed time interval to detect whether the signal monitored by scanner 16 is repeated. The wait time of this pre-programmed time interval is preferably controlled by a timing device (e.g., a 555 timer chip) in the authorized carrier detector circuit. A logic device chip in the authorized carrier detector circuit 18 will preferably be used to validate whether the monitored radio transmission is pulsed on and off a certain required number of times in the pre-programmed time interval. Detector circuit 18 will, therefore, act as a system buffer, screening out most radio transmissions which are not intended to open the locked security structure. When the authorized carrier detector circuit 18 has determined that the monitor of radio transmission has been pulsed on and off by the emergency response person the required number of times within the pre-programmed time interval, the circuit will signal relay 20 to activate security structure unlocking mechanism 22.

The authorized carrier detector circuit can be activated by various methods including (1) the DC shift from an automatic gain control circuit in scanner/receiver 16 reacting to the presence of a received carrier signal or (2) the presence of the approximately one second "squelch tail" present at the audio output of scanner/receiver 16. This "squelch tail" occurs at the end of a received carrier signal and is inherent to all FM receivers employing a squelch circuit to quiet the output of the receiver during the absence of a received carrier signal. In other words, the present system will only operate to unlock the security structure if the microphone transmitter key switch or activation button of the response persons' radio transmitter is rapidly and repeatedly turned on and off in the immediate presence of the security structure unlocking system's antenna. This further ensures that spurious signals will not unlock security structure 24, even if these transmitters are positioned relatively near to the locked security structure.

Present scanner 16 scans each of the particular pre-programmed response frequencies for a particular pre-programmed period of time, typically on the order of less than one second. During this pre-programmed period of time, the authorized carrier detection circuit 18 is used to determine whether the detected communications sent on this frequency have been pulsed on and off a pre-programmed number of times (typically being set as two to four times), within this pre-programmed scan period of time.

Accordingly, the only procedure required to be learned by the response personnel to open a locked security structure having security structure opening assembly 12 coupled thereto is to position themselves rather close to the security structure and then rapidly turn their microphone transmitter key switch or activation button on their radio transmitter on and off several times. No adjustment need be made to their existing equipment and no coded signals need be sent. Another advantage is that different procedures do not need to be adopted by different agencies to open different locked security structures. Furthermore, the present system ensures that regular routine communications made over restricted radio frequencies are not sufficient by themselves to inadvertently open these locked security structures. Rather, a more conscious and positive act of rapid turning on and off the radio transmitter 10 by response personnel is required. The rapidly pulsing on and off of the radio microphone transmitter key or activation button on transmitter 10 is a very simple act, which can very quickly and easily be performed by the response personnel desiring to open a locked security structure. Finally, even in the event that the particular security structure desired to be opened by the present security structure unlocking system is not so equipped with the present security structure opening system, the amount of time "wasted" in attempting to open the security structure by simply quickly turning the microphone transmitter button on the radio transmitter on and off would be exceptionally small.

As will be explained in greater detail hereunder, scanner 16 and authorized carrier detection circuit 18 acting together, or in further combinations with private line detector circuit 30, digital burst detector circuit 31 and decoder circuit 32, are adapted to provide a heirarchy of additional levels of security which enable opening assembly 12 to identify a particular radio transmitter 10. The particular authorized individual who is operating the radio transmitter 10, will be known or identified even when a variety of different individuals from the same response agency all are using the same radio frequency for transmission of their radio broadcasts.

The ability of the present invention to distinguish between individual response personnel on the basis of their individual radio transmitters before allowing the opening of security structure 24 provides added levels of security, as it is frequently desirable to restrict access to a security structure 24 to only certain individuals within a particular response agency.

Accordingly, the present system is able to identify the particular individual within a response agency, as follows.

In any radio transmission, there are typically a number of different transmissions occurring simultaneously. In particular, at a first level, all radio transmissions propagate along a basic carrier wave. As has been set forth above, scanner 16 and authorized carrier circuit 18 are adapted to respectively sense whether a radio transmission is occurring on one of the pre-set or pre-programed response frequencies and determine whether this radio transmission is pulsed. When these two criteria are satisfied, the present system activates to unlock the security structure. The limitation with this system is that the system will activate the unlocking mechanism for any radio transmitting a pulsed signal on an authorized frequency.

At least three additional levels of progressively increased security can be added to the basic concept set forth above. These levels operate on the principle of detecting the presence of additional transmissions accompanying the basic carrier wave or in examining particular characteristics of the additional transmissions accompanying the carrier wave. The presence or absence of these additional transmissions or the transmission characteristics thereof propagated along with the basic carrier wave are used to distinguish between different radio transmitters even when the transmissions themselves are pulsed and occurring on the same frequency.

At a first level of added security, a private line fixed tone or digital code can also be transmitted along with the carrier wave. When the present system is operating at this first level of increased security, authorized carrier detector circuit 18 sends an output signal along the path shown by arrow 42. In contrast, when not operating levels of increased security, (as was set forth hereabove, and as was set forth in the parent application, being Ser. No. 08/764,502, filed Dec. 12, 1996), the output signal from authorized carrier detector circuit 18 is instead sent along the path shown by arrow 40. The signal, therefore, is passed directly to relay 20, thereby signaling relay 20 to activate security structure unlocking mechanism 22, which in turn activates lock assembly 25, unlocking security structure 24.

When the present system is operating at the first level of increased security, private line detector circuit 30 received the output signal from authorized carrier circuit 18 along path 42. Private line detector circuit 30 is adapted to sense for the presence of a private line signal accompanying the base carrier wave. Should private line detector circuit 30 sense such a private line transmission, it will output a signal along the path shown by arrow 44 to relay 20, thereby signaling relay 20 to activate security structure unlocking mechanism 22 which thereby activates lock assembly 25, unlocking security structure 24.

By equipping only selected members of an emergency response agency with radio transmitters 10 which transmit such a private line signal along with the carrier wave, the present system, through its private line detector circuit 30 will be able to distinguish between those radio transmitters which emit private line signals and those which do not. Accordingly, access granted to particular security structures can be provided only to those certain individuals in any particular emergency response agency who's radio transmitters emit the private line signals concurrent with the base carrier wave. Importantly, however, all personnel in the agency are still able to transmit their radio broadcasts on the same frequency without interfering with the normal communications of any members of the agency.

At a second level of increased security, (which simultaneously operates in addition to the first level of increased security), selected radio transmitters 10 are adapted to emit a private line signal as above, however, radio transmitter 10 is also adapted to emit a sub-audible digital burst or a sub-audible sine wave tone along with the carrier wave and the private line signal.

Operating at the second level of increased security, the signal from private line detector circuit 30 is sent along the path shown by arrow 46 to a digital burst detector circuit 31. The digital burst signal is typically encoded. Digital burst detector circuit 31 is specifically adapted to detect the presence of such a digital burst or a sub-audible sine wave tone traveling along with the carrier wave and the private line signal. The digital burst signal, which is typically encoded, is not decoded by digital burst detector circuit 31, rather only the presence of the burst signal is detected. Should digital burst detector circuit 31 detect the presence of such a digital burst or a sub-audible sine wave tone, it will output a signal along the path shown by arrow 45 to relay 20, thereby signaling relay 20 to activate security structure unlocking mechanism 22, which thereby activates lock assembly 25, unlocking security structure 24. Accordingly, by equipping only certain members of a response agency with a radio transmitter which transmits a digital burst in addition to a private line signal along a carrier wave, system security is further enhanced as digital burst detector circuit 31 will be able to distinguish between those radio transmitters which emit digital burst signal in addition to private line signals and those which do not.

An important advantage of the second level of security operating in addition to the first level of increased security is that a hierarchy of access can be set up as follows. A first group of security structures can be set to be activated at the basic level of security. A second group of security structures can be set up to be activated at the first level of increased security. A third group of security structures can be set up to be activated at the second level of increased security, etc. This sort of heirarchy of pre-authorized accessibility permits great flexibility in setting up systems where different personnel are desired to have different levels of accessibility to different structures.

Operating at a third level of progressively increased security, (concurrent with the first and second levels of increased security), the output signal from digital burst detector circuit 31 is sent along the path indicated by arrow 47. Decoder circuit 32 is adapted to actually decode the logic transmitted by the digital burst, rather than simply detect the presence of the digital burst as had been done in the aforementioned second level of security. Decoder circuit 32 is programmed such that, for pre-authorized codes only, it will output a signal along the path shown by arrow 48 to relay 20, thereby signaling relay to activate security structure unlocking mechanism 22.

The digital burst can be used to send various types of information and various commands back and forth between the field unit and the dispatch center. In the case of emergency response personnel, the digital burst emitted from the radio can be used to identify the individual vehicle (in the case of a police car or fire truck), or the particular police officer (in the case of a hand-held police radio). Such basic forms of digital burst technology is presently used by major radio manufacturers such as Motorola, Inc. of Schauburg, Ill., General Electric Company of Fairfield, Conn., Erricson Inc. of New York, N.Y. and Midland Cellular of Fairfield, Calif.

As explained above, the present invention determines whether a particular individual is authorized to open security structure 24 on the basis of which individual radio transmitter they are using to access the system. This, of course, assumes that the authorized individual possesses the authorized radio transmitter. A serious problem arises, therefore, when an authorized radio transmitter is lost or stolen. The present invention provides an additional security system to avoid this problem as follows.

A non-crippled antenna 70 sends received radio signals along path 71 to a secondary scanner/receiver 80. Non-crippled antenna 70 is capable of receiving radio transmissions from remote locations, as will be explained. The various response agencies can each digitally transmit updated lists of which individual radio transmitters are authorized at any given time. This list of authorized radio transmitters can be updated daily or at even more frequent intervals. Accordingly, radio transmitter is lost or stolen from an agency, its particular identification private line signal and/or its particular digital burst signal can be removed from a list of authorized radio transmitters.

As antenna 70 is non-crippled, a signal sent from the response agency dispatcher at a central base station can simultaneously be sent to any number of security structure unlocking systems of the present invention within a wide geographic radius. The signal sent simultaneously informs the unlocking systems that a particular radio transmitter's particular private line signal and/or a particular digital burst signal is, or is not, still authorized. As will be explained, private line detector circuit 30 and/or digital burst detector circuit 31 and/or decoder circuit 32 are each adapted such that access to the unlocking feature of the present system is denied should the present system be signaled that the presence of a particular private line or digital burst signal which would have otherwise activated the unlocking mechanism is no longer authorized.

Secondary scanner 80 is adapted to scan various response frequencies for the transmission of updated authorization lists from the various response agencies. The frequencies monitored by secondary scanner 80 could be carried out at those frequencies already being scanned by scanner/receiver 16. However, it is also possible that the updated authorization lists could be transmitted on other frequencies provided that these other frequencies be added to a list of frequencies periodically scanned by secondary scanner/receiver 80.

Scanner 16 and secondary scanner 80 are in electronic communication with signals being transmitted back and forth along path 73 therebetween such that signals received by scanner 16 can be compared with an updated listing of authorized users as received by secondary scanner 80. Accordingly, a signal which is transmitted on an authorized frequency as received by scanner 16 will still be prevented from accessing the unlocking mechanism of the present invention if the signal from the particular radio transmitter 10 is not currently authorized as per the signals received from secondary scanner 80.

Accordingly, signals received by way of non-crippled antenna 70 will be distinguished from those received by way of crippled antenna 14 such that the signals received by non-crippled antenna 70 will not be used to activate the unlocking system of the present invention.

The logic of deciding whether a particular radio transmission is authorized as per the most recent transmission of authorized users received by secondary scanner 80 can be performed at any of the private line, digital burst or decoder levels of increased security. As such, any one of the private line detector circuit 30, digital burst detector circuit 31 or decoder circuit 32 will decide whether a signal received through crippled antenna 14 and scanner 16 is currently authorized based upon comparison with the information received by way of non-crippled antenna 70 and secondary scanner 80.

As a further security back-up, a recording system is provided to keep an "activity log" of the persons who activated the unlocking system, and the time at which the security structure was unlocked. This is preferably accomplished by using existing circuitry provided within scanner/receiver 16, or by providing additional circuitry as is required to be added to scanner/receiver 16 to accomplish this function. It is possible, however, to alternatively provide recording circuity in a separate recording device which can alternatively be physically attached or in electronic communication with one or more of security structure 24, lock assembly 25, relay 20 or security structure unlocking mechanism 22.

Security structure unlocking mechanism 22 is not, by itself, a novel feature of the present invention. Accordingly, it may include any existing actuator mechanisms for unlocking or unlocking and opening security structures, as long as such mechanisms are electronically controllable.

An additional security feature of the present system is timer 60 which is connected to lock assembly 25 and is adapted to re-lock security structure 24 after its being unlocked for a period of time. Alternatively, the functions provided by timer 60 could instead be programmed directly into the circuitry of scanner/receiver 16. The latter approach would be more preferable as this would reduce the number of separate components in the present system, although either could be accomplished within the scope of the present invention. Timer 60 (standing either as an independent component or as an internal component of scanner/receiver 16) thereby prevents the security structure from inadvertently remaining open for extended periods of time. This consideration is especially important in the case of police or ambulance personnel racing through an opened security gate, without then having to take the time to re-lock the structure behind them. The period of time chosen in preferable programmable directly into timer 60.

What is claimed is:

1. A secure structural assembly comprising:

a movable security structure having a closed, locked position and an opened, unlocked position;

a lock assembly formed to lock said movable security structure in its closed position;

an unlocking mechanism coupled to and formed for unlocking of said lock assembly;

an authorized user input device for providing a signal to the unlocking mechanism to unlock the lock assembly in response to an authorized user input and;

a response security structure-opening assembly coupled to said unlocking mechanism at a position by-passing an authorized user input device and including a reduced sensitivity radio frequency receiver responsive only to radio frequency signal transmitted from within a near range of said receiver on at least one radio frequency, and said security structure-opening assembly further being responsive only to detection of said signal in said radio frequency to actuate said unlocking mechanism.

2. The secure structural assembly as defined in claim 1, said response security structure-opening assembly includes a digital burst detector circuit formed to detect the presence of a non-continuous digital burst radio frequency signal.

3. The secure structural assembly as defined in claim 1 further comprising, a timer adapted to automatically re-lock said movable security structure after said movable security structure has been unlocked for a period of time.

4. The secure structural assembly as set out in claim 1, wherein the response security structure-opening assembly is adapted to by-pass said authorized user input device upon receiving at least two pulsed radio frequency signals.

5. A method of opening a secure structure having an authorized user input device for a user of the secure structure to gain access thereto, comprising the steps of:

coupling a radio frequency receiver assembly to a lock assembly for said locked structure at a position by-passing said authorized user input device, said receiver assembly being formed to detect the presence of signals on a restricted radio frequency that are not recognized by the authorized user input device, and said receiver assembly being formed to detect only signals transmitted from within a near range of said receiver and being formed to be responsive to a detected radio frequency signal to unlock said lock assembly; and monitoring at least one restricted radio frequency with said receiver assembly; and unlocking said lock assembly in response to receipt of a signal on the restricted radio frequency transmitted from near range to said receiver assembly.

6. A method for opening a locked structure using a remote radio transmitter, said locked structure being equipped with a radio frequency scanner/receiver formed to detect radio frequency signals from a user on a user frequency and coupled to control an unlocking mechanism connected to a lock assembly for said structure, comprising the steps of:

a) monitoring at least one radio frequency other than said user frequency with said scanner/receiver to detect radio signals transmitted on said at least one radio frequency other than said user frequency;

b) concurrently with said step of monitoring, operating said remote radio transmitter to transmit a radio signal on said at least one radio frequency other than said user frequency;

c) receiving said radio signal via said scanner/receiver, said scanner/receiver being adapted to have a very short range; and d) signaling said unlocking mechanism to unlock said locked structure in response to receipt of said radio signal.

7. The method for opening a locked structure as set out in claim 6, and the step of using an authorized carrier detector circuit located in said scanner/receiver to determine if said radio signal is repeatedly pulsed on and off within a fixed interval of time;

and during said operating step, transmitting a repeated pulsed on-off signal within a predetermined time interval.

8. The method for opening a locked structure as set out in claim 7, and the step of using a private line detector circuit to determine if said radio signal has a private line component; and during said operating step, transmitting a private line signal.

9. The method for opening a locked structure as set out in claim 7, and the step of using a digital burst detector circuit to determine if said radio signal has a digital burst component; and during said operating step, transmitting a digital burst signal.

10. The method for opening a locked structure as set out in claim 9 and the step of using a decoder circuit to decode said digital burst component of said radio signal; and during said operating step, transmitting an encoded digital burst signal.

11. The method for opening a locked structure as set out in claim 8, 9 or 10 and the steps of a) operating a secondary scanner/receiver to receive by radio a list of authorized radio signals transmitted from a base source; and b) analyzing said radio signal to determine if said radio signal is an authorized radio signal.

12. The method for opening a locked structure as set out in claim 6, and the step of passing a signal from said scanner/receiver to said unlocking mechanism to unlock said locked structure in response to receipt of a radio frequency signal on the user frequency.

13. The method of claim 12, wherein, the scanner/receiver is adapted to receive radio frequency signals from a user of the locked structure and in response thereto open the locked structure; and also to receive different radio frequency signals from other persons needing access to the locked structure.

14. The method of claim 13 wherein, the different radio frequency signals are on a restricted emergency radio frequency.

* * * * *